US010463553B2

(12) United States Patent
Gafar-Schaner et al.

(10) Patent No.: US 10,463,553 B2
(45) Date of Patent: Nov. 5, 2019

(54) APPARATUS FOR USE WITH FURNITURE FOR PROTECTING A USER AGAINST INJURIES

(71) Applicants: Taofiki Olawale Gafar-Schaner, San Leandro, CA (US); Joseph Robert Ferry, Vallejo, CA (US)

(72) Inventors: Taofiki Olawale Gafar-Schaner, San Leandro, CA (US); Joseph Robert Ferry, Vallejo, CA (US)

( * ) Notice: Subject to any disclaimer, the term of this patent is extended or adjusted under 35 U.S.C. 154(b) by 141 days.

(21) Appl. No.: 15/663,756

(22) Filed: Jul. 30, 2017

(65) Prior Publication Data

US 2018/0177655 A1 Jun. 28, 2018

Related U.S. Application Data

(60) Provisional application No. 62/439,542, filed on Dec. 28, 2016.

(51) Int. Cl.
*A61G 7/05* (2006.01)
*A61G 5/10* (2006.01)

(52) U.S. Cl.
CPC ..... *A61G 7/0522* (2016.11); *A61G 5/1091* (2016.11); *A61G 7/052* (2016.11); *A61G 2203/723* (2013.01)

(58) Field of Classification Search
CPC .... A61G 5/1091; A61G 7/052; A61G 7/0522; A61G 2203/70; A61G 2203/723
See application file for complete search history.

(56) References Cited

U.S. PATENT DOCUMENTS

| | | | | |
|---|---|---|---|---|
| 5,487,197 | A * | 1/1996 | Iskra, Jr. | A47C 7/021 297/452.41 |
| 5,687,438 | A * | 11/1997 | Biggie | A61G 5/1043 297/284.6 |
| 6,694,557 | B1 * | 2/2004 | Bobey | A61G 7/015 5/425 |
| 6,892,405 | B1 * | 5/2005 | Dimitriu | A61G 7/001 5/609 |
| 2008/0028533 | A1 * | 2/2008 | Stacy | A61G 7/015 5/713 |
| 2013/0270881 | A1 * | 10/2013 | Fowler | A61G 7/1023 297/219.1 |

* cited by examiner

*Primary Examiner* — Ryan A Reis
(74) *Attorney, Agent, or Firm* — Horizon IP Pte. Ltd.

(57) ABSTRACT

Apparatuses and method are disclosed for use with a furniture for providing protection to a user against injuries. An apparatus for use with the furniture for providing protection to a user against injuries includes an inflatable unit including an exterior surface including a number of housing elements. The inflatable unit also includes an airtight chamber capable of being filled with a filler. The inflatable unit also includes a valve attached to an orifice present on the airtight chamber. The valve is configured to secure the filler into the airtight chamber. The apparatus further includes at least one strapping element configured to securely mount the inflatable unit to the furniture. The apparatus also includes at least one fastener configured to attach to the at least one strapping element while mounting the inflatable unit to the furniture.

20 Claims, 5 Drawing Sheets

APPARATUS FOR USE WITH FURNITURE FOR PROTECTING A USER AGAINST INJURIES

FIELD OF THE INVENTION

The present disclosure generally relates to apparatuses for providing protection to a user, such as a patient, against injuries. More specifically, the invention relates to an apparatus for use with furniture for providing protection to a user against injuries. The apparatus is an inflatable apparatus that can be securely mounted on any suitable furniture such as, a bed, chair, or furniture railing via but not limited to a number of straps.

BACKGROUND OF THE INVENTION

The users, such as patients, inside or outside of a hospital often require safety measures to avoid getting hurt by their voluntary or involuntary actions, such as but not limited to, body movement during seizures. For example, a patient resting in a hospital bed may inadvertently come in physical contact with a bed rail during a seizure and may get hurt. Rails of the hospital bed are usually made up of hard plastic or metal, which may hurt the patient during an epileptic episode or similar occurrences. The bed rails also house necessary buttons or functions that may be operated by staff and patients for changing height, and position etc. of the bed. The unfortunate aspect of these bed rails is innate design framework; hard plastics or metal that may increase the risk of injury to a patient.

Existing products for providing safety to patients, and users are usually expensive, non-standardized, and/or inefficient. For example, current practice for treating an individual on "seizure precautions" remains non-standardized, and is usually accomplished by taping linen, for example, blankets, cotton, bath towels, etc., to each of the patient's side rails or using other inefficient methods of securing linens to the rails i.e. elastic, knot tying, and so forth. Although, there are various products available in the market designed specifically to pad furniture rails, but these products are usually large, bulky, inconvenient, and bed/brand/furniture specific. Further, the high cost of current standardized items decrease the widespread implementation as they may create a financial burden on facilities or private individuals. Due to high cost of the standardized products or pads, they are usually not available for all individuals (or patients) in need, leading to the use of unstandardized, unsafe, unhygienic, and unverified makeshift padding methods mentioned above. Further, for private facilities such as, but not limiting to, hospitals, nursing homes, research labs, or pharmacies these makeshift items do not meet the safety, quality, or standards these facilities set out to accomplish. Furthermore, use of non-standardized products creates an unsightly and unprofessional atmosphere. Therefore, these products are rarely stocked by hospitals, and when ordered, are difficult to store on units for patient use. Due to these products' inefficiency and lack of availability, the users, like nurses, in turn rely on former and most commonly used solution of attaching the linens to patient care furniture such as bedrails, chairs, and the like.

Some examples of non-standardized accessories include—Tape, linen, gowns, clothing, garments, and other items mounted to furniture railings that are not sufficient and do not provide the prerequisite safety for individuals requiring padded furniture. Linen and tape are huge reservoirs of bacteria and often times are left on the furniture railings for hours and sometimes days at a time until becoming visibly soiled. This reservoir can house highly resistant and/or dangerous microbes like *Clostridium difficile* (or *C. difficile*) or Methicillin-resistant *Staphylococcus Aureus* (MRSA) infections, hence increasing the chances for a hospital acquired infection. This practice may further endanger patients at risk for skin breakdown, aspiration, or other emergency situations. In addition, due to common positioning of the protective linen on various hospital bed rails, the exterior buttons such as bed controls, get fully or partially covered and become inaccessible to the nurses and other users, hence making it difficult to use. The inability to adjust bed positioning can lead to decreased compliance and consistency when frequent patient repositioning is vital to protecting patients from hospital acquired pressure related injuries. More acutely, the inaccessibility of bed controls may cause a delay in care in emergency situations, i.e. aspiration, shortness or breath, or "Code Blue" scenarios.

In light of above, there exists need for apparatuses and techniques that can be used with the furniture for providing safety against injuries to the users.

SUMMARY

This Summary is provided to introduce a selection of concepts in a simplified form that are further described below in the Detailed Description. Further, this Summary is not intended to identify key features or essential features of the claimed subject matter, nor it is intended to be used to limit the scope of the claimed subject matter.

The present disclosure provides an apparatus or an inflatable apparatus for use with a furniture for providing protection to the users against injuries. The apparatus may be mounted to the furniture, such as, but not limiting to, bed rails, via but not limited to multiple straps made of fabric, plastic, or other such materials that is readily available for users. The disclosed apparatus is configured to provide solutions to the aforementioned problems detailed above with the current system.

The present disclosure finds particular application in providing extra comfort and support to a user while using the furniture. For example, the apparatus may be attached or mounted to the furniture like but not limited to, a bed, a chair, a table, a patient care furniture, and so forth. The apparatus may protect the user such as, a patient, from injuries, and may provide extra comfort.

An embodiment of the present disclosure provides an apparatus for use with a furniture for providing protection to a user against injuries. The user may be a patient. The apparatus includes an inflatable unit including an exterior surface including a number of housing elements. The inflatable unit also includes an airtight chamber capable of being filled with a filler. The inflatable unit also includes a valve attached to an orifice present on the airtight chamber. The valve is configured to secure the filler into the airtight chamber. The apparatus further includes at least one strapping element configured to securely mount the inflatable unit to the furniture. The apparatus also includes at least one fastener configured to attach to the at least one strapping element while mounting the inflatable unit to the furniture.

Another embodiment of the present disclosure provides a method for providing protection to a user against injuries. The method includes attaching at least one apparatus to a furniture. The apparatus includes an inflatable unit including an exterior surface including a number of housing elements. The inflatable unit further includes an airtight chamber capable of being filled with a filler. The inflatable unit furthermore includes a valve attached to an orifice present on the airtight chamber. The valve is configured to secure the filler into the airtight chamber. The apparatus further includes at least one strapping element configured to securely mount the inflatable unit to the furniture. The apparatus further includes at least one fastener configured to attach to the at least one strapping element while mounting the inflatable unit to the furniture.

Yet another embodiment of the present disclosure provides an apparatus for use with a patient care furniture for providing protection to a patient against injuries. The apparatus also includes an inflatable unit including an exterior surface including a number of housing elements. The inflatable unit further includes an airtight chamber capable of being filled with a filler. The inflatable unit further includes a valve configured to secure the filler into the airtight chamber. The apparatus further includes at least one strapping element configured to securely mount the inflatable unit to the furniture. The apparatus furthermore includes at least one fastener configured to attach to the at least one strapping element while mounting the inflatable unit to the furniture.

According to an aspect of the present disclosure, the exterior surface is formed using a material having one or more properties including at least one of soft, water resistant, skin friendly, antimicrobial, and non-irritant.

According to another aspect of the present disclosure, the filler includes at least one of a gas, air, a fluid, and gel.

According to another aspect of the present disclosure, the valve is further configured to regulate flow of the filler in the airtight chamber while inflating and deflating of the inflatable unit According to another aspect of the present disclosure, the housing elements comprise one or more cushioned layers.

According to yet another aspect of the present disclosure, the furniture is a patient care furniture.

According to yet another aspect of the present disclosure, a material of the at least one strapping element is formed using a fabric material provisioned to allow alteration of a length of the at least one strapping element, further wherein the material comprises at least one of fiber, silicon, and plastic. In some embodiments, the strapping element is formed using a suitable material having elasticity.

According to yet another aspect of the present disclosure, the fastener is configured to attach the at least one strapping element together, further wherein the fastener is in the form of at least one of a buckle, a button, a Velcro, and a hook-loop type attachment.

According to another aspect of the present disclosure, the inflatable unit has a shape comprising at least one of a rectangular, square, round, oval, straight, circular, L-shaped, multi-sided, and curved.

Other and further aspects and features of the disclosure will be evident from reading the following detailed description of the embodiments, which are intended to illustrate, not limit, the present disclosure.

BRIEF DESCRIPTION OF THE DRAWINGS

The illustrated embodiments of the disclosed subject matter will be best understood by reference to the drawings, wherein like parts are designated by like numerals throughout. The following description is intended only by way of example, and simply illustrates certain selected embodiments of devices, systems, and processes that are consistent with the disclosed subject matter as claimed herein.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows. Numerous specific details are described to provide a thorough understanding. However, in certain instances, well-known or conventional details are not described in order to avoid obscuring the description. References to one or an embodiment in the present disclosure are not necessarily references to the same embodiment; and, such references mean at least one.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Reference throughout this specification to "a select embodiment," "one embodiment," or "an embodiment" means that a particular feature, structure, or characteristic described in connection with the embodiment is included in at least one embodiment of the disclosed subject matter. Thus, appearances of the phrases "a select embodiment," "in one embodiment," or "in an embodiment" in various places throughout this specification are not necessarily referring to the same embodiment.

Figure 1A:
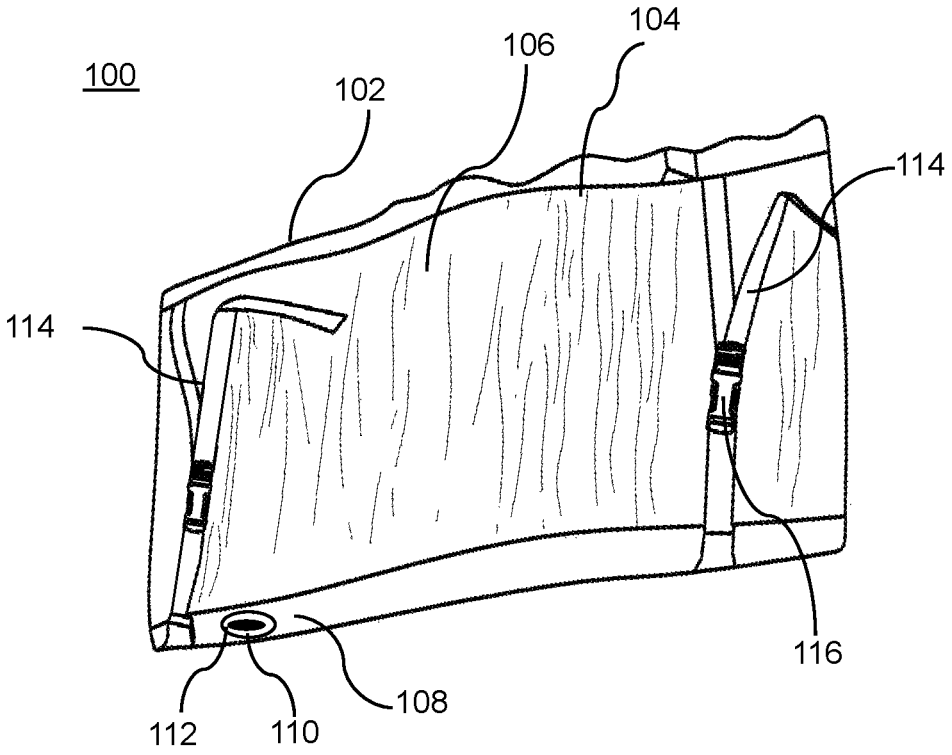
FIG. 1A is a schematic diagram illustrating an exemplary apparatus for use with a furniture for providing protection to a user against injuries, in accordance with an embodiment of the present disclosure.

FIG. 1A is a schematic diagram illustrating an exemplary apparatus 100 for use with a furniture for providing protection to a user against injuries, in accordance with an embodiment of the present disclosure. In an example, the furniture is a patient care furniture and the user is a patient. The apparatus 100 includes an inflatable unit 102 including an exterior surface 104. The exterior surface includes a number of housing elements 106. The exterior surface 104 may be formed using a material having one or more properties. The material of the exterior surface 104 and/or the housing elements 106 may be soft, water resistant, skin friendly, antimicrobial, and non-irritant. The exterior surface 104 of the inflatable unit 102 is easy to clean. Further, the material for the exterior surface 104 can be a woven or non-woven fabric formed using a natural, synthetic or a combination thereof. In some embodiments, the exterior surface 104 is spill-proof and may have antimicrobial properties.

The housing elements 106 may include one or more cushioned layers formed using a suitable material such as, but not limited to, foam, plastic, silicon, and so forth. The housing elements 106 may be joined to a seam along one or more edges of the inflatable unit 102. The housing elements 106 may wrap around and cover substantially the entire inflatable unit 102 when the apparatus 100 is substantially inflated or filled. The housing elements 106 may be cushioned to provide comfort to a user while using the furniture. For example the apparatus 100 may be mounted on a back of a chair for providing cushion and comfort to the user.

The inflatable unit 102 also includes an airtight chamber 108 capable of being filled with a filler (not shown). The filler may include such as, but not limited to, gas, air, fluid, and gel. The inflatable unit 102 may have a suitable shape such as, but not limited to, a rectangular, square, round, oval, straight, circular, L-shaped, multi-sided, and curved. In some embodiments, the airtight chamber 108 in the inflatable unit 102 may have a self-inflating character. It means that the inflatable unit 102 is compressible and returns to the expanded configuration when expanded.

The inflatable unit 102 also includes a valve 110 attached to an orifice 112 present on the airtight chamber 108. The valve 110 can be configured to secure the filler into the airtight chamber 108. The valve 110 may also be configured to regulate a flow of the filler in the airtight chamber 108 while inflating and deflating of the inflatable unit 102. In some embodiments, the valve 110 permits the filler inside the airtight chamber 108 in its relaxed state, while it does not permit the outflow of the filler even upon applying pressure. Once the airtight chamber 108 is full or the pressure difference between inside and outside becomes negligible whichever maybe the case, more filler may be optionally added through external pressurized means, such as, but not limited to, a pump. In an embodiment, the valve 110 in its operational position may not permit flow of filler out of the airtight chamber 108, but can be opened to deflate or adjust the filler pressure within the airtight chamber 108. Once the inflatable unit 102 is filled up to the optimum required capacity, the apparatus 100 is ready to be used.

Further, a shape and size of the inflatable unit 102 may vary as per the requirement. For example, the shape and size of the inflatable unit 102 may be in accordance with a size and shape of the furniture on which the apparatus 100 need to be mounted.

The apparatus 100 further includes at least one strapping element 114 configured to securely mount the inflatable unit 102 to the furniture. A material of the at least one strapping element 114 may include a fabric material provisioned to allow alteration of a length of the at least one strapping element 114. The material may include, but not limited to, fiber, silicon, plastic, and combination thereof. In some embodiments, the strapping element is formed using a suitable material having elasticity. Though the FIG. 1A shows two strapping element(s) 114 but a person ordinarily skilled in the art will understand that the inflatable unit 102 may include more or less number of the strapping element 114. Further the length of and a width of the strapping element 114 may vary depending on the size and shape of the inflatable unit 102. The strapping element 114 may be attached to the housing elements 106 using stitching, sewing, rivets, grommets, glue, screws, or any other similar methods known in the art. The apparatus 100 (hereinafter, the apparatus 100 also referred as an inflatable apparatus 100) depending upon is size could incorporate, one, two, three, or more strapping element 114 attached to the housing elements 106 of the inflatable apparatus. The strapping element 114 could be attached in parallel, crisscross or other suitable fashion to securely mount the inflatable apparatus 100 to the furniture. In some embodiments, a length of the strapping element 114 can be changed to allow easy and secure mounting of the inflatable apparatus 100 to the furniture.

The apparatus 100 further includes at least one fastener 116 configured to attach to the at least one strapping element 114. The at least one fastener 116 may be configured to attach the at least one strapping element 114 together. The at least one fastener 116 may be in the form such as, but not limited to, a buckle, a button, a Velcro, and a hook-loop type attachment.

The apparatus 100 can be attached to or mounted on the furniture such as, a patient care furniture. Examples of the furniture may include, but are not limited to, a bed, a chair, a table, a sofa, a door, a bed rail, and so forth. The apparatus may provide protection to a user against injuries. For example, during a seizure, the apparatus 100 mounted on the bed rail may protect a patient from hurting himself/herself. The apparatus 100 can easily be mounted on any suitable furniture using the at least one strapping element 114.

Figure 1B:
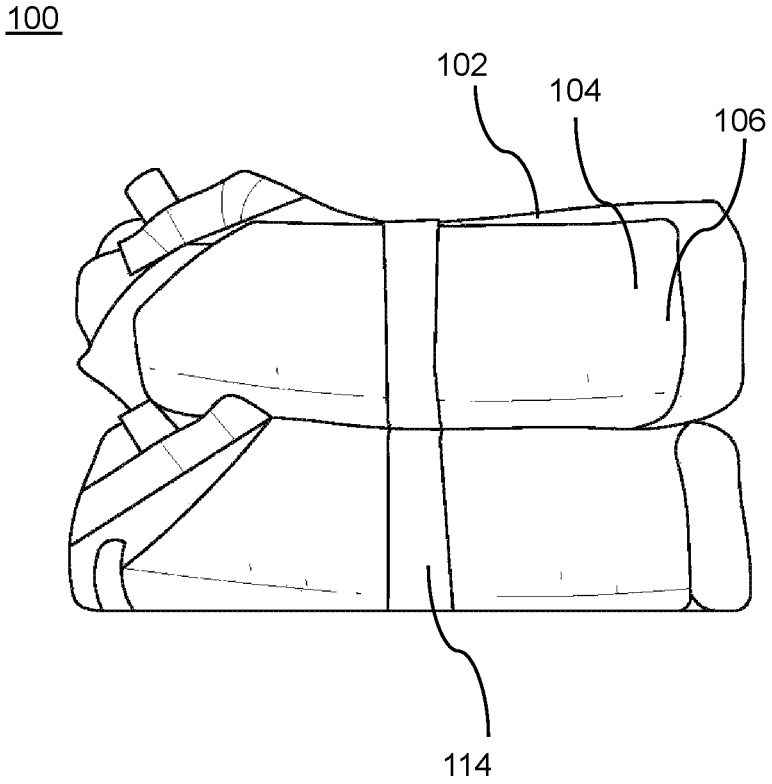
FIG. 1B is another schematic diagram illustrating the apparatus of FIG. 1A in a folded configuration, in accordance with an embodiment of the present disclosure.

Further, the apparatus 100 is foldable and can be stored by folding it to save space. FIG. 1B is schematic diagram illustrating the exemplary apparatus 100 in a folded configuration. In one of the exemplary embodiments, the inflatable apparatus 100 can be deflated and easily and efficiently stored when not in use. The inflatable apparatus 100 has desirable storage dimensions and is lightweight and designed for easy and efficient portability and can be stowed when not in use. In an embodiment, the at least one strapping element 114 may be used to secure the apparatus in the folded configuration. The inflatable unit 102 may re-gain its shape and size once expanded. Upon requirement, the inflatable apparatus 100 can self-inflate and can be used to mount on any furniture for providing protection to user from injuries and enhancing comfort.

Figure 2:
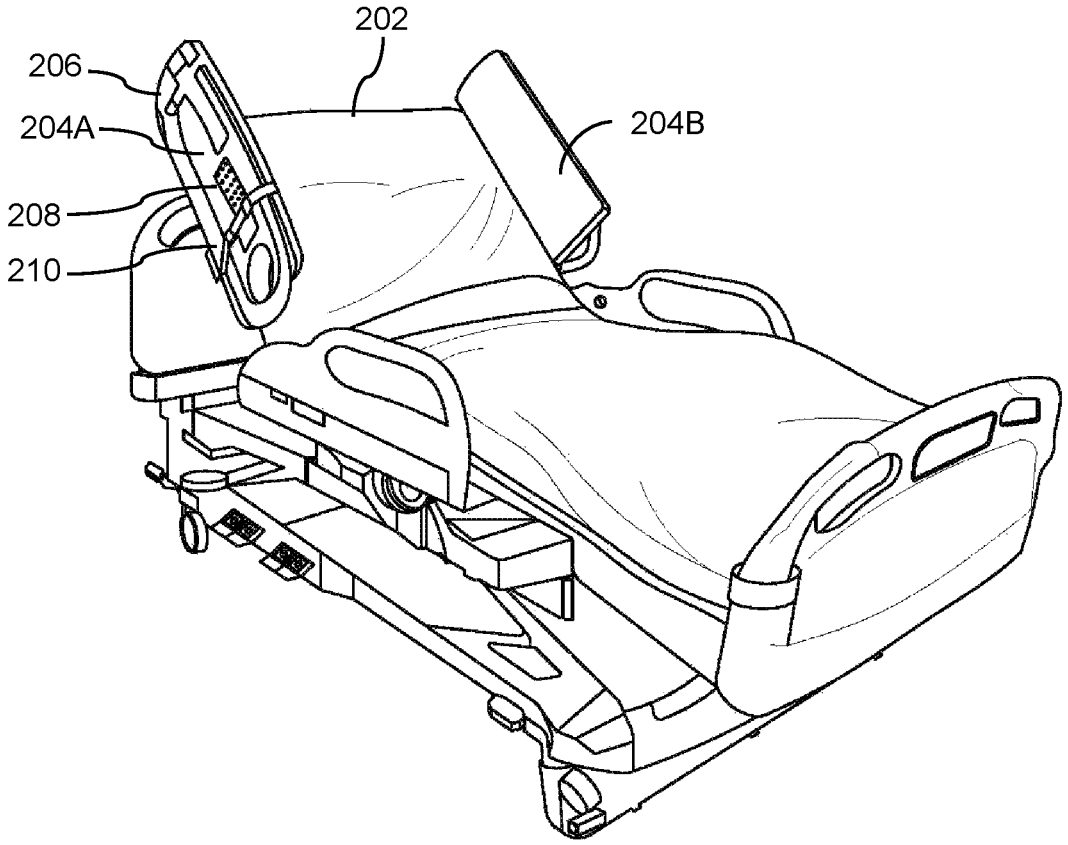
FIG. 2 illustrates an apparatus mounted on an exemplary patient care furniture, in accordance with an embodiment of the present disclosure.

FIG. 2 illustrates an apparatus 204A mounted on an exemplary patient care furniture 202, in accordance with an embodiment of the present disclosure. As shown, another apparatus 204B may also be mounted on the patient care furniture 202. The patient care furniture 202 can be a bed. The apparatuses 204A-204B (Hereinafter, also referred as inflatable apparatuses 204A-204B) are mounted on a bed rail 206 on both sides of the patient care furniture 202. The apparatuses 204A-204B are mounted on the bed rail 206 of a pre-existing bed. In this exemplary illustration there are two inflatable apparatuses 204A-204B are mounted on upper pair of the bed rail 206. However, in alternate embodiments, the inflatable apparatuses 204A-204B may be mounted on a lower pair of bed rails or any other mountable options present in the patient care furniture 202.

A person ordinarily skilled in the art will understand any number of apparatus 204A-204B may be mounted on the patient care furniture 202. The apparatuses 204A-204B may be mounted on furniture by attaching at least one strapping element 210 on the bed rail 206. The strapping element 210 may be arranged in a parallel, a crisscross, or any suitable manner. The bed rail 206 may include a button panel 208 including one or more buttons. As shown, the button panel 208 is easily accessible by a user when needed even after mounting the apparatuses 204A-204B.

Figure 3A:
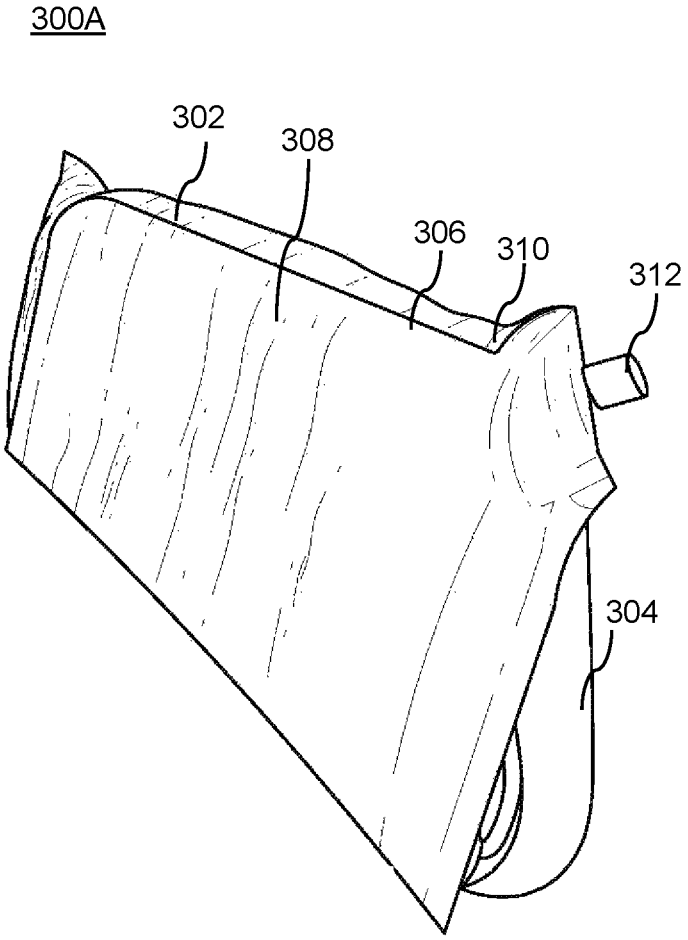
FIG. 3A illustrates a front side of an apparatus mounted on a furniture, in accordance with an embodiment of the present disclosure.

FIG. 3A illustrates a front side 300A of an apparatus 302 mounted on a furniture 304, in accordance with an embodiment of the present disclosure. The furniture can be a bed rail of a patient care bed. As discussed with reference to FIG. 1A, the apparatus 302 is similar to the apparatus 100 in structure and functionality. The apparatus 302 includes an inflatable unit 306 including a number of housing elements 308. The inflatable unit 306 includes an airtight chamber 310 capable of being filled with a filler (not shown). The filler may include at least one of a gas, air, fluid, and gel. The inflatable unit 306 also includes a valve 312 configured to secure the filler into the airtight chamber 310. The valve 312 may also regulate the flow of the filler in the airtight chamber 310 while inflating and deflating of the inflatable unit 102. Further, the inflatable unit 306 may inflate and deflate automatically as per the pressure. In some embodiments, the valve 312 permits the filler inside the airtight chamber 310 in its relaxed state, while it does not permit the outflow of the filler even upon applying pressure.

Figure 3B:
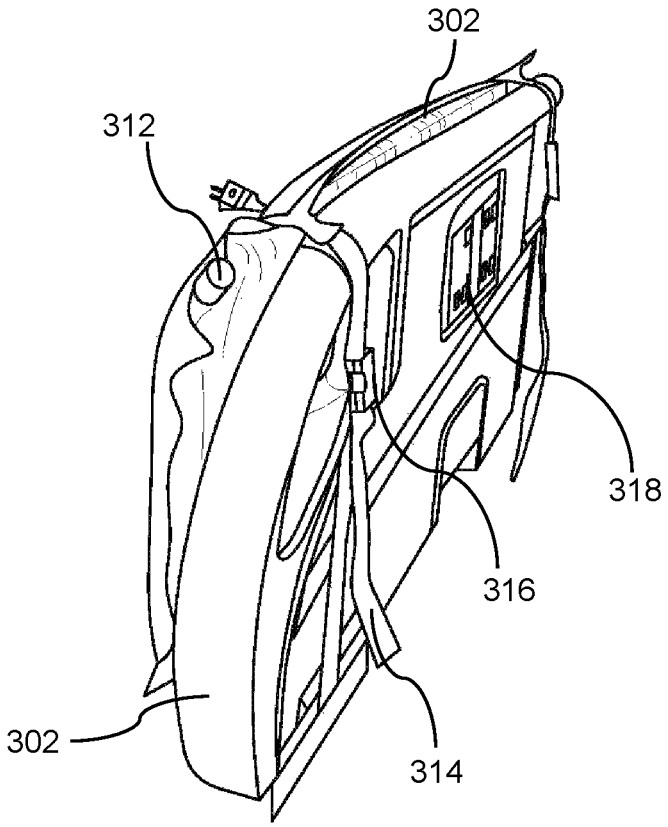
FIG. 3B illustrates a backside of the apparatus of FIG. 3A.

FIG. 3B illustrates a backside 300B of the apparatus 302 mounted on the furniture 304. The apparatus 302 further includes at least one strapping element 314 configured to securely mount the inflatable unit 102 to the furniture 304 i.e. the bed rail of the patient furniture. The strapping element 314 may be formed using a fabric material provisioned to allow alteration of a length of the at least one strapping element 314. The material may include, but not limited to, fiber, silicon, plastic, and combination thereof. The strapping element 314 may be a flexible, textile strap, or made from any similar material known to a person skilled in the art. The at least one strapping element 314 may be attached in a parallel, a crisscross, or other suitable fashion to securely mount the inflatable apparatus 302 to the furniture 304.

In some embodiments, the strapping element 314 of the apparatus 302 is coupled with a fastener 316 for securely locking the ends of the strapping element 314 thereby securely mounting the inflatable apparatus 302 to the furniture 304. The strapping element 314 in this exemplary embodiment is coupled with the fastener 316, shown as buckles. In alternative embodiments, the fastener 316 may be one or a combination of more than one kind such as, but not limited to a buckle, Velcro, buttons, hook & loop and so forth. The combination of the strapping element 314 and the fastener 316 ensures that the inflatable apparatus 302 during use is securely mounted on the bed rail of the furniture 304, thereby providing protection to a user from injuries and enhancing comfort.

The bed rail of the patient furniture 304 may include a button panel 318 including one or more buttons. As shown, the button panel 318 is easily accessible by a user when needed even after mounting the apparatus 302.

The disclosed apparatus can be easily mounted on any patient care furniture and at the same time provides the physicians, healthcare providers, and other trained personnel with an easy access to the button panels.

The disclosed apparatus can be used to enhance cushioning of the furniture, which in turn may enhance comfort for the user.

The disclosed apparatus are easy to mount on any suitable furniture such as but not limited to, a chair, a bed, a table, a patient bed, and railing of the furniture. Further, the disclosed apparatus may be used with any type of furniture. Further, the size and shape of the apparatus may be customized according to the furniture.

The disclosed apparatus may protect patients from getting injured during for example, but not limited to, during seizures, epileptic episode, or similar occurrence.

The present disclosure provides an inflatable apparatus for use with a patient care furniture to provide protection against injuries to a user. The user can be a patient.

The present disclosure further provides an inflatable apparatus for use with a patient care furniture offering an ergonomic solution by providing open access to buttons and controls attached to the patient care furniture. The inflatable apparatus is configured in a manner that requires no additional workload or strain to a user while operating the patient care furniture for activities such as position change, head lifting and the like.

The present disclosure furthermore provides a cost effective, logistically efficient, and standardized method of implementing safety to patients in need of protection in acute or long term care facilities or in their private living arrangements, through an inflatable apparatus mountable on a patient care furniture.

It will be appreciated that several of the above-disclosed and other features and functions, or alternatives thereof, may be desirably combined into many other different apparatuses or applications. Various presently unforeseen or unanticipated alternatives, modifications, variations, or improvements therein may be subsequently made by those skilled in the art, which are also intended to be encompassed by the following claims.

While there has been shown and described herein what are presently considered the preferred embodiments of the present disclosure, it will be apparent to those skilled in the art that various changes and modifications can be made therein without departing from the scope of the present disclosure as defined by the appended claims.

While certain embodiments have been described, these embodiments have been presented by way of example only, and are not intended to limit the scope of the present disclosure. Indeed, the novel methods, devices, and systems described herein may be embodied in a variety of other forms. Furthermore, various omissions, substitutions, and changes in the form of the methods, devices, and systems described herein may be made without departing from the spirit of the present disclosure. The accompanying claims and their equivalents are intended to cover such forms or modifications as would fall within the scope and spirit of the present disclosure.

The above description does not provide specific details of manufacture or design of the various components. Those of skill in the art are familiar with such details, and unless departures from those techniques are set out, techniques, known, related art or later developed designs and materials should be employed. Those in the art are capable of choosing suitable manufacturing and design details.

The terminology used herein is for the purpose of describing particular embodiments only and is not intended to be limiting of the disclosure. It will be appreciated that several of the above disclosed and other features and functions, or alternatives thereof, may be combined into other systems, methods, or applications. Various presently unforeseen or unanticipated alternatives, modifications, variations, or improvements therein may subsequently be made by those skilled in the art without departing from the scope of the present disclosure as encompassed by the following claims.

We claim:

1. An apparatus for use with a furniture for providing protection to a user against injuries, the apparatus comprising:

an inflatable unit comprising:

an exterior surface comprising a plurality of housing elements, wherein the plurality of housing elements is joined to a seam along one or more edges of the inflatable unit;

an airtight chamber capable of being filled with a filler; and a valve positioned to an orifice present on the airtight chamber, the valve is configured to secure the filler into the airtight chamber;

at least one strapping element configured to securely mount the inflatable unit to the furniture; and at least one fastener configured to attach to the at least one strapping element while mounting the inflatable unit to the furniture, wherein the inflatable unit at the inflated or filled state is positioned along an interior side of a bed rail of the furniture facing a patient and fastened via the at least one strapping element at an exterior side of the bed rail by the at least one fastener, wherein the bed rail includes a control panel on the exterior side that remains accessible by a user after the inflatable unit is fastened.

2. The apparatus of claim 1, wherein the exterior surface is formed using a material having one or more properties comprising at least one of soft, water resistant, skin friendly, antimicrobial, and non-irritant.

3. The apparatus of claim 1, wherein the filler comprises at least one of a gas, air, fluid, and gel.

4. The apparatus of claim 3, wherein the valve is further configured to regulate a flow of the filler in the airtight chamber while inflating and deflating of the inflatable unit.

5. The apparatus of claim 1, wherein the plurality of housing elements comprises one or more cushioned layers.

6. The apparatus of claim 1, wherein the furniture is a patient care furniture.

7. The apparatus of claim 1, wherein a material of the at least one strapping element comprises a fabric material provisioned to allow alteration of a length of the at least one strapping element, the material includes at least one of fiber, silicon, and plastic.

8. The apparatus of claim 1, wherein the fastener is configured to attach the at least one strapping element together, the fastener is in the form of at least one of a buckle, a button, a Velcro, and a hook-loop type attachment.

9. The apparatus of claim 1, wherein a shape of the inflatable unit comprises at least one of a rectangular, square, round, oval, straight, circular, L-shaped, multi-sided, and curved.

10. A method for providing protection to a user against injuries, the method comprising:

attaching at least one apparatus to a furniture, wherein the apparatus comprises:

an inflatable unit comprising:

an exterior surface comprising a plurality of housing elements, wherein the plurality of housing elements is joined to a seam along one or more edges of the inflatable unit;

an airtight chamber capable of being filled with a filler; and a valve positioned to an orifice present on the airtight chamber, the valve is configured to secure the filler into the airtight chamber;

at least one strapping element configured to securely mount the inflatable unit to the furniture; and at least one fastener configured to attach to the at least one strapping element while mounting the inflatable unit to the furniture, wherein the inflatable unit at the inflated or filled state is positioned along an interior side of a bed rail of the furniture facing a patient and fastened via the at least one strapping element at an exterior side of the bed rail by the at least one fastener, wherein the bed rail includes a control panel on the exterior side that remains accessible by a user after the inflatable unit is fastened.

11. An inflatable apparatus for use with a patient care furniture for providing protection to a patient against injuries, the apparatus comprising:

an inflatable unit comprising:

an exterior surface comprising a plurality of housing elements, wherein the plurality of housing elements is joined to a seam along one or more edges of the inflatable unit;

an airtight chamber capable of being filled with a filler; and a valve configured to secure the filler into the airtight chamber;

at least one strapping element configured to securely mount the inflatable unit to the furniture; and at least one fastener configured to attach to the at least one strapping element while mounting the inflatable unit to the furniture, wherein the inflatable unit at the inflated or filled state is positioned along an interior side of a bed rail of the patient care furniture facing a patient and fastened via the at least one strapping element at an exterior side of the bed rail by the at least one fastener, wherein the bed rail includes a control panel on the exterior side that remains accessible by a user after the inflatable unit is fastened.

12. The inflatable apparatus of claim 11, wherein the exterior surface is formed using a material having one or more properties, the properties include at least one of soft, water resistant, skin friendly, antimicrobial, and non-irritant.

13. The inflatable apparatus of claim 12, wherein the valve is positioned to an orifice present on the airtight chamber.

14. The inflatable apparatus of claim 11, wherein filler comprises at least one of a gas, air, fluid, and gel.

15. The inflatable apparatus of claim 14, wherein the valve is further configured to regulate flow of the filler in the airtight chamber while inflating and deflating of the inflatable unit.

16. The inflatable apparatus of claim 11, wherein the plurality of housing elements comprises one or more cushioned layers.

17. The inflatable apparatus of claim 11, wherein a material of the at least one strapping element comprises a fabric material provisioned to allow alteration of a length of the at least one strapping element, the material comprises at least one of fiber, silicon, and plastic.

18. The inflatable apparatus of claim 11, wherein the fastener is configured to attach the at least one strapping element together, the fastener is in the form of at least one of a buckle, a button, a Velcro, and a hook-loop type attachment.

19. The inflatable apparatus of claim 11, wherein the inflatable unit has a shape comprising at least one of a rectangular, square, round, oval, straight, circular, L-shaped, multi-sided, and curved.

20. The inflatable apparatus of claim 1, wherein the strapping element extends across a width of the bed rail after the inflatable unit is fastened by the at least one fastener.

* * * * *